US005642928A

United States Patent [19]

Hylton

[11] Patent Number: 5,642,928

[45] Date of Patent: Jul. 1, 1997

[54] DECORATIVE LIGHT STRIPS FOR IN-LINE SKATES

[76] Inventor: Anthony E. Hylton, 145 Steeles Ave. East, North York, Ontario, Canada, M3M-3Y5

[21] Appl. No.: 598,120

[22] Filed: Feb. 7, 1996

[51] Int. Cl.[6] ..... B60Q 1/00

[52] U.S. Cl. ..... 362/61; 362/800; 362/227; 362/234

[58] Field of Search ..... 362/61, 227, 234, 362/247, 800

[56] References Cited

U.S. PATENT DOCUMENTS 4,839,777 6/1989 Janko et al. ..... 362/800

5,327,329 7/1994 Stiles ..... 362/61

5,544,027 7/1996 Orsano ..... 362/800

*Primary Examiner*—Carroll B. Dority

[57] ABSTRACT

Decorative light strips for in-line skates including at least one light strip adhesively coupled to a pair of in-line skates. Each of the light strips include a pair of control lines for supplying a plurality of light emitting diodes therein with power. The control lines each have coupling mechanisms which are adapted to allow a plurality of light strips to be interconnected and supplied power by a common power source comprising a battery and associated battery compartment.

12 Claims, 3 Drawing Sheets

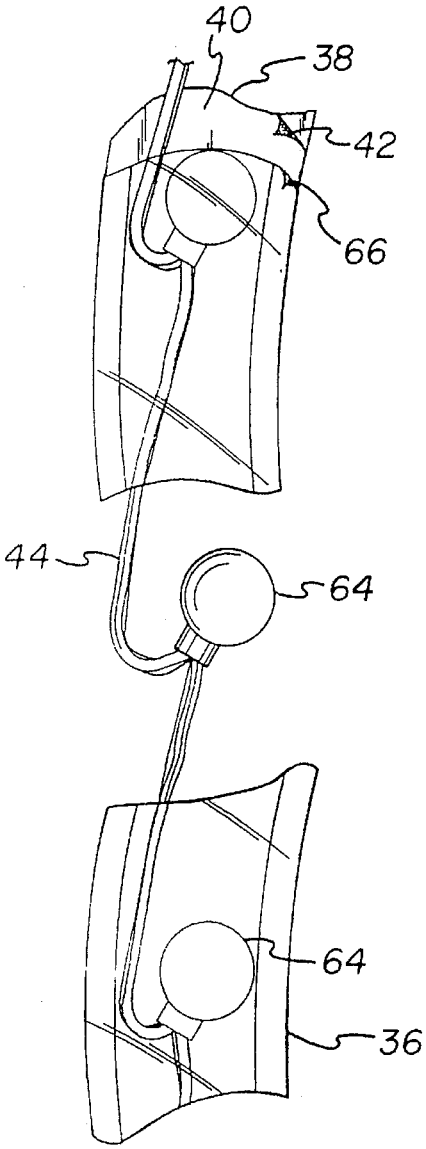
FIG. 4
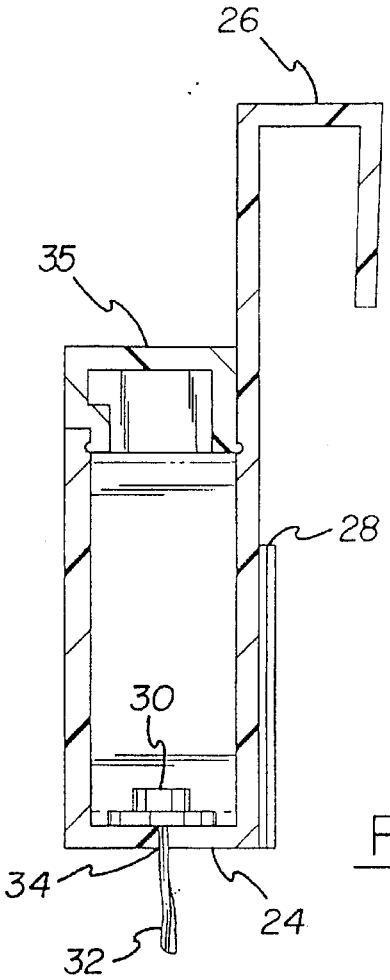
FIG. 3
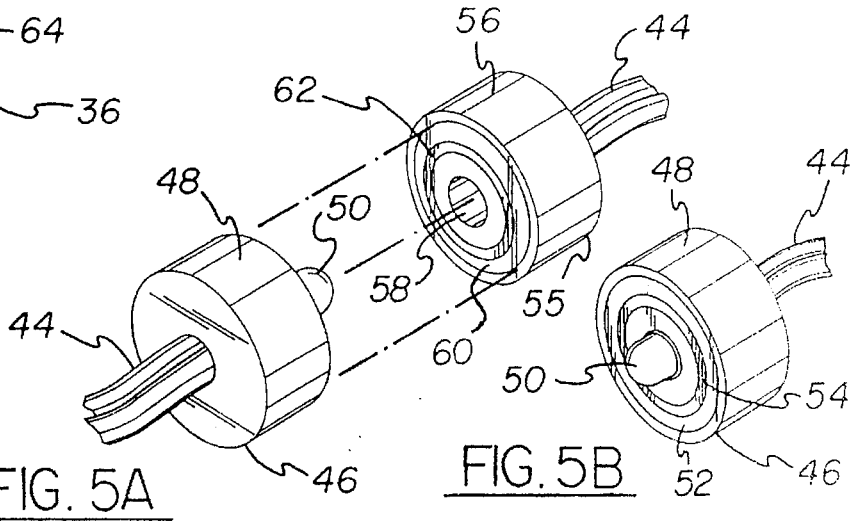
FIG. 5A
FIG. 5B

DECORATIVE LIGHT STRIPS FOR IN-LINE SKATES

BACKGROUND OF THE INVENTION

1. Field of the Invention

The present invention relates to decorative light strips for in-line skates and more particularly pertains to selectively attaching a plurality of interlocked LED containing light strips to the boot of an in-line skate.

2. Description of the Prior Art

The use of lighting attachments for skates is known in the prior art. More specifically, lighting attachments for skates heretofore devised and utilized for the purpose of increasing the safety of a user are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,327,329 to Stiles a lighting apparatus comprising a linear array of lights for use with in line blade type skates. U.S. Pat. No. 4,336,573 to Carter discloses an illuminated skate such as skateboard, a roller skate or the like whereby light is transmitted from the wheels. U.S. Pat. No. 4,363,502 to Bakerman discloses an illuminative skate wheel with a power source thereof contained therein. U.S. Pat. No. 4,367,515 to Beard discloses a roller skate light attachment operable to be fitted onto a roller skate. Lastly, U.S. Pat. No. 5,278,733 to St. Thomas discloses a lighting apparatus for connection to a roller skate wheel.

In this respect, the decorative light strips for in-line skates according to the present invention substantially departs from the conventional concepts and designs of the prior art, and in so doing provides an apparatus primarily developed for the purpose of selectively attaching a plurality of interlocked LED containing light strips to the boot of an in-line skate.

Therefore, it can be appreciated that there exists a continuing need for new and improved decorative light strips for in-line skates which can be used for selectively attaching a plurality of interlocked LED containing light strips to the boot of an in-line skate. In this regard, the present invention substantially fulfills this need.

SUMMARY OF THE INVENTION

In view of the foregoing disadvantages inherent in the known types of light attachments for skates now present in the prior art, the present invention provides an improved decorative light strips for in-line skates. As such, the general purpose of the present invention, which will be described subsequently in greater detail, is to provide new and improved decorative light strips for in-line skates apparatus and method which has all the advantages of the prior art and none of the disadvantages.

To attain this, the present invention essentially comprises a device for use with a conventional in-line roller skate including a boot portion with a plastic shell, inner lining, and a single row of linearly aligned wheels rotatably coupled thereto at a bottom extent thereof. For supplying power to the device, a battery and an associated battery compartment are included. The battery compartment is formed of a plastic material with a rectangular configuration. The battery compartment comprises an open top, closed bottom wall, and periphery formed therebetween defining an interior space. An inverted generally U-shaped clip is coupled at a first end to the periphery adjacent the open end. The clip further has a second end for inserting between the plastic shell and lining of the in-line roller skate thereby securing the battery compartment thereto. An adhesive strip is positioned on an outer surface of the periphery adjacent to the clip for further securing the battery compartment to the in-line roller skate. A battery contact is situated within the interior space at a lower extent thereof. The battery contact is adapted to releasably couple to the battery by utilizing a pair of locking contacts. A power supply line is connected to the contact and extended through an aperture formed in the bottom wall for transmitting power.

Also included is a plurality of light strips each comprising a lower layer having a reflective top surface comprising a metallic material. The lower layer also has an adhesive bottom surface which is adapted to adhere to the plastic shell of the in-line skate. A pair of control lines comprising a first control line and a second control line are further included. Each control line is securely situated on the reflective top surface of the lower layer and has a pair of ends extending from opposed sides of the light strip. For interlocking different light strips, a pair of coupling snaps are included. The snaps include a male snap having a cylindrical portion with a protective plastic outer cover. A bulb contact extends from the cylindrical portion and is connected to a first end of the first control line. An intermediate contact is formed about the bulb with an insulator situated therebetween. The male intermediate contact is connected to a first end of the second control line. The snaps also include a female snap having a cylindrical portion with a protective plastic outer cover. An aperture contact is formed in the cylindrical portion and connected to a second end of the first control line. The aperture is adapted to releasably receive a bulb of a male plug upon coupling. A female intermediate contact is formed about the aperture with an insulator situated therebetween. The female intermediate contact is connected to a second end of the second control line for contacting the male intermediate contact of a male snap. For lighting purposes, a plurality of energy efficient light emitting diodes are securely situated on the reflective top surface of the lower layer. Such light emitting diodes are connected to the control lines in parallel and are adapted to actuate upon the receipt of power. Finally, a transparent upper layer with a similar size and shape as the lower layer is included. The upper layer has an adhesive bottom surface for adhering to the light emitting diodes, control lines, and upper surface of the lower layer. The upper layer thus secures each component with respect to each other. In use, the light strips may be interlocked and the control lines of at least one light strip is connected to the power supply line for actuating the light emitting diodes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved decorative light strips for in-line skates which has all the advantages of the prior art light attachments for skates and none of the disadvantages.

It is another object of the present invention to provide new and improved decorative light strips for in-line skates which may be easily and efficiently manufactured and marketed.

It is a further object of the present invention to provide new and improved decorative light strips for in-line skates which is of a durable and reliable construction.

An even further object of the present invention is to provide new and improved decorative light strips for in-line skates which is susceptible of a low cost of manufacture with regard to both materials and labor, and which accordingly is then susceptible of low prices of sale to the consuming public, thereby making such light attachments for skates economically available to the buying public.

Still yet another object of the present invention is to provide new and improved decorative light strips for in-line skates which provides in the apparatuses and methods of the prior art some of the advantages thereof, while simultaneously overcoming some of the disadvantages normally associated therewith.

Still another object of the present invention is to selectively attach a plurality of interlocked LED containing light strips to the boot of an in-line skate.

Lastly, it is an object of the present invention to provide new and improved decorative light strips for in-line skates including at least one light strip adhesively coupled to a pair of in-line skates. Each of the light strips include a pair of control lines for supplying a plurality of a light emitting diodes therein with power. The control lines each have coupling mechanisms which are adapted to allow a plurality of light strips to be interconnected and supplied power by a common power source comprising a battery and associated battery compartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the battery compartment depicted in FIG. 2.

FIG. 4 is a cut-away view of a light strip depicted in FIG. 2.

FIG. 5 is an enlarged view of the contact snaps employed in the present invention.

Similar reference characters refer to similar parts throughout the several views of the drawings.

DESCRIPTION OF THE PREFERRED EMBODIMENT

Figure 1:
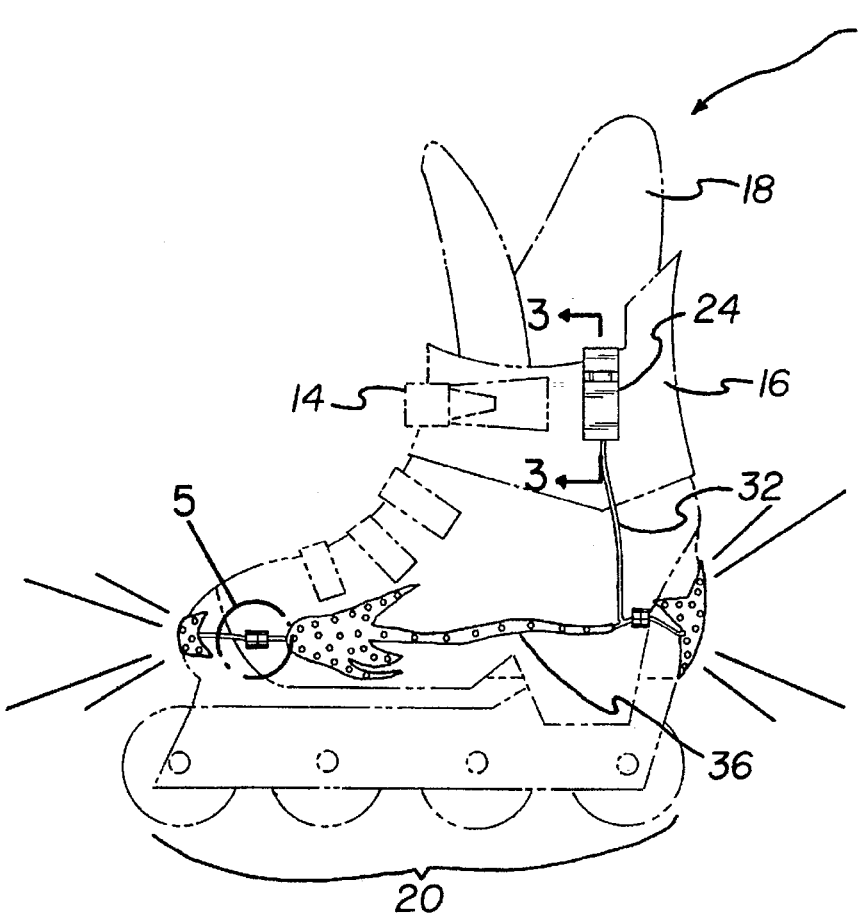
FIG. 1 is an illustration of the preferred embodiment of the decorative light strips for in-line skates constructed in accordance with the principles of the present invention.
Figure 2:
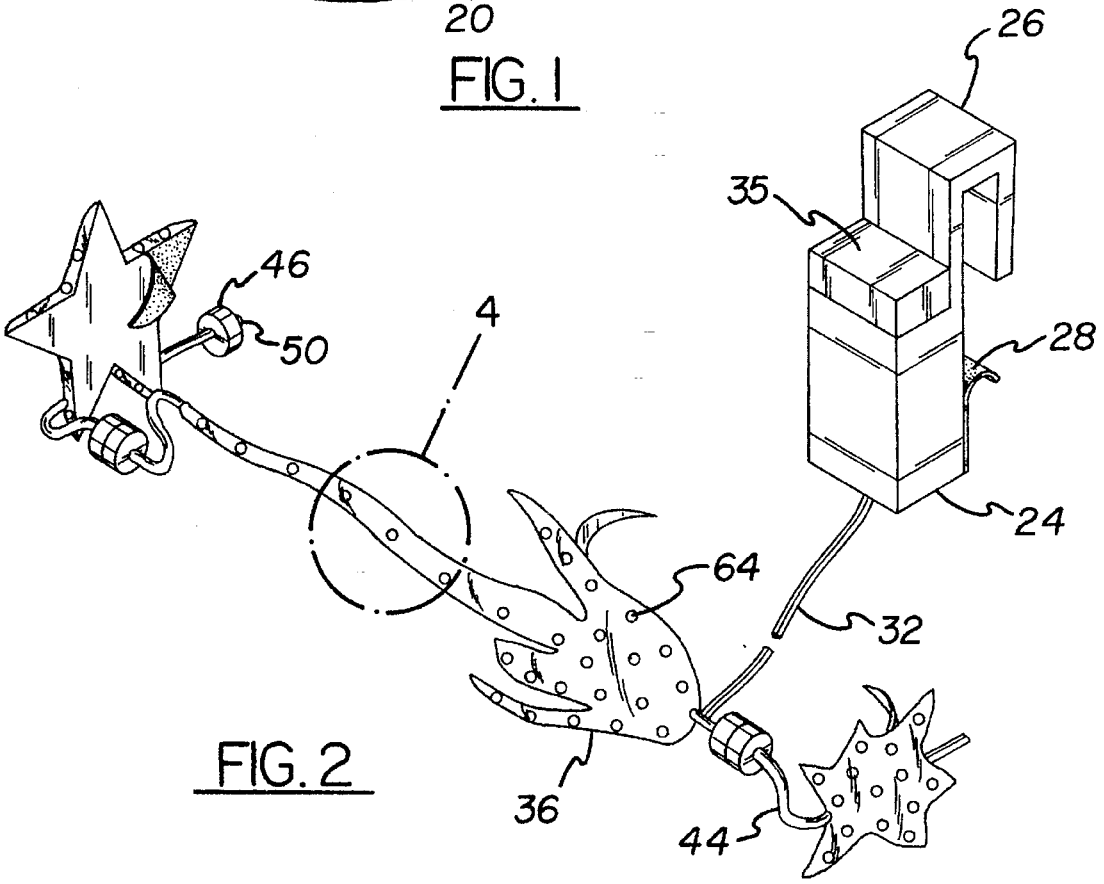
FIG. 2 is a perspective illustration of the present invention.

With reference now to the drawings, and in particular to FIG. 1 thereof, new and improved decorative light strips for in-line skates embodying the principles and concepts of the present invention and generally designated by the reference numeral 10 will be described. The present invention, the new and improved decorative light strips for in-line skates, is comprised of a plurality of components. Such components in their broadest context include power source, battery compartment, and light strips. Such components are individually configured and correlated with respect to each other so as to attain the desired objective.

More specifically, it will be noted that the system 10 of the present invention provides a device for use with a conventional in-line roller skate including a boot portion 14 with a plastic shell 16, inner lining 18, and a single row of linearly aligned wheels 20 rotatably coupled thereto at a bottom extent thereof.

A power source 22 is included comprising a conventional battery. For containing the battery, a battery compartment 24 formed of a plastic material is included with a rectangular configuration. The battery compartment comprises an open top, closed bottom wall, and periphery formed therebetween defining an interior space. An inverted generally U-shaped clip 26 is coupled at a first end thereof to the periphery adjacent the open end. The clip further has a second end for inserting between the plastic shell and lining of the in-line roller skate thereby securing the battery compartment thereto. An adhesive strip 28 is positioned on an outer surface of the periphery adjacent to the clip for further securing the battery compartment to the in-line roller skate. A battery contact 30 is situated within the interior space at a lower extent thereof. The battery contact is adapted to releasably couple to the battery by utilizing a pair of locking contacts. A power supply line 32 is connected to the contact and extended through an aperture 34 formed in the bottom wall for transmitting power. Finally, a lid 35 and associated detents are included for preventing the accidental removal of the battery.

Also included is a plurality of light strips 36 each comprising a lower layer 38 having a reflective top surface 40 comprising a metallic material. Alternatively, the top surface may be composed of a phosphorescent material. The lower surface also has an adhesive bottom surface 42 which is adapted to adhere to the plastic shell of the in-line skate.

A pair of control lines 44 comprising a first control line and a second control line are further included. Each control line is securely situated on the reflective top surface of the lower layer and has a pair of ends extending from opposed sides of the light strip.

For interlocking different light strips, a pair of coupling snaps are included. The snaps include a male snap 46 having a cylindrical portion with a protective plastic outer cover 48. A bulb contact 50 extends from the cylindrical portion and is connected to a first end of the first control line. An intermediate contact 52 is formed about the bulb with an insulator 54 situated therebetween. The male intermediate contact is connected to a first end of the second control line. The snaps also included a female snap having a cylindrical portion with a protective plastic outer cover 56. An aperture contact 58 is formed in the cylindrical portion and connected to a second end of the first control line. The aperture is adapted to releasably receive a bulb of a male plug upon coupling. A female intermediate contact 60 is formed about the aperture with an insulator 62 situated therebetween. The female intermediate contact is connected to a second end of the second control line for contacting the male intermediate contact of a male snap upon coupling.

For lighting purposes, a plurality of energy efficient light emitting diodes 64 are securely situated on the reflective top surface of the lower layer. Such light emitting diodes are connected to the control lines in parallel and are adapted to actuate upon the receipt of power.

Finally, a transparent upper layer 66 with a similar size and shape as the lower layer is included. The upper layer has an adhesive bottom surface for adhering to the light emitting diodes, control lines, and upper surface of the lower layer. The upper layer thus secures each component with respect to each other.

Figure 6:
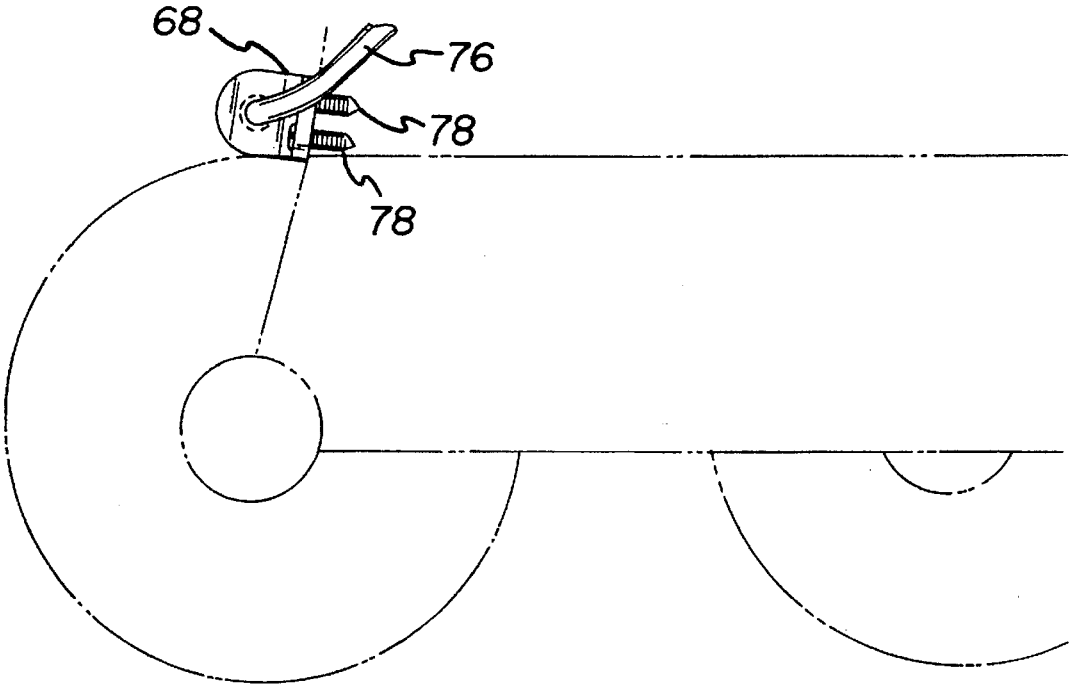
FIG. 6 is a plan side view of the generator employed in the alternate embodiment.
Figure 7:
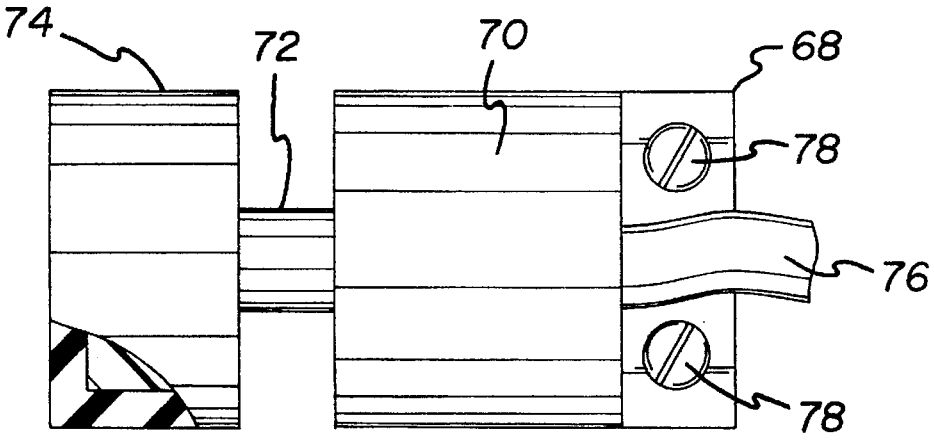
FIG. 7 is an enlarged plan top view of the generator employed in the alternate embodiment of the present invention.

An alternate embodiment, as shown in FIG. 6 and 7, illustrates the use of a small generator 68 in lieu of the battery and associated battery compartment of the preferred embodiment. The generator comprises a cylindrical housing 70. A rotor shaft 72 is rotatably coupled to the housing and is extended therefrom. A drive wheel 74 is formed of a elastomeric material and is coupled about the rotor. A power supply line 76 extends from the generator for transmitting power therefrom. Finally, a plurality of screws 78 are provided to couple the housing adjacent to a wheel of the skate whereby the drive wheel abuts a wheel of the skate. Upon the rotation wheel, the generator effectuates power for supplying to the light strip via the power supply line.

In use, the light strips may be interlocked and the control lines of at least one light strip is connected to the power supply line for actuating the light emitting diodes.

The present invention allows in-line skates to be custom decorated with light strips comprised of a wide variety of shapes, indicia, or the like. The inclusion of such light strips contributes to the novelty of any pair of skates while also increasing the visibility of a user. The present invention thus constitutes a viable safety measure. Decorative light strips for in-line skates may be retrofitted to an existing pair of skates or included during manufacture.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. New and improved decorative light strips for use with a conventional in-line roller skate including a boot portion with a plastic shell, inner lining, and a single row of linearly aligned wheels rotatably coupled thereto at a bottom extent thereof comprising, in combination:

a power source comprising a conventional battery;

a battery compartment formed of a plastic material with a rectangular configuration, the battery compartment comprising an open top, a closed bottom wall, a periphery formed therebetween defining an interior space, and an inverted generally U-shaped clip coupled at a first end to the periphery adjacent the open end, the clip further having a second end for inserting between the plastic shell and lining of the in-line roller skate thereby securing the battery compartment thereto, the battery compartment further comprising an adhesive strip positioned on an outer surface of the periphery adjacent to the clip for further securing the battery compartment to the in-line roller skate, a battery contact situated within the interior space and adapted to releasably couple to the battery, and a power supply line connected to the contact and extended through an aperture formed in the bottom wall for transmitting power; and a plurality of light strips each comprising:

a lower layer having a reflective top surface and an adhesive bottom surface for adhering to the plastic shell of the in-line skate, a pair of control lines comprising a first control line and a second control line, each control line securely situated on the reflective top surface of the lower layer and having a pair of ends extending from opposed sides of the light strip, a pair of coupling snaps including a male snap, the male snap having a cylindrical portion with a protective plastic outer cover, a bulb contact extended from the cylindrical portion and connected to a first end of the first control line, an intermediate contact formed about the bulb with an insulator situated therebetween, the intermediate contact connected to a first end of the second control line; and a female snap, the female snap having a cylindrical portion with a protective plastic outer cover, an aperture contact formed in the cylindrical portion and connected to a second end of the first control line for receiving a bulb of a male snap, an intermediate contact formed about the aperture with an insulator situated therebetween, the intermediate contact connected to a second end of the second control line for contacting the intermediate contact of a male snap, a plurality of energy efficient light emitting diodes securely situated on the reflective top surface of the lower layer and connected in parallel with the control lines, the light emitting diodes adapted to actuate upon the receipt of power, and a transparent upper layer with a similar size and shape as the lower layer, the upper layer having an adhesive bottom surface for adhering to the light emitting diodes, control lines, and upper surface of the lower layer thereby securing each component with respect to each other, whereby the light strips may be interlocked and the control lines of at least one light strip is connected to the power supply line for actuating the light emitting diodes.

2. Decorative light strips for use with skates comprising:

a power means; and at least one light strip coupled to the skates comprising a control line connected to the power means, a coupling means for selectively connecting to additional light strips, and a plurality of lighting means securely situated on the strip and adapted to actuate upon the receipt of power, whereby the light strips may be interlocked and receive power from the power means.

3. The decorative light strips for skates as set forth in claim 2 wherein the power means includes a conventional battery.

4. The decorative light strips for skates as set forth in claim 3 and further including a battery compartment with a rectangular configuration formed of a plastic material, the battery compartment comprising an open top, a closed bottom wall, a periphery formed therebetween defining an interior space, and an inverted generally U-shaped clip coupled at a first end to the periphery adjacent to the open end, the clip further having a second end for inserting between the plastic shell and lining of the in-line roller skate thereby securing the battery compartment thereto, the battery compartment further having an adhesive strip positioned on an outer surface of the periphery adjacent to the clip for securing the battery compartment to the in-line roller skate, a battery contact situated within the interior space and adapted to releasably couple to the battery, and a power supply line connected to the contact and extended through an aperture formed in the bottom wall for transmitting power to the light strip.

5. The decorative light strips for skates as set forth in claim 2 wherein the power means includes a small generator comprising a cylindrical housing, a rotor shaft rotatably coupled to the housing with a drive wheel coupled thereto, a power supply line, and a plurality of screws for coupling the housing adjacent to a wheel of the skate whereby the drive wheel abuts the wheel of the skate and upon the rotation thereof, the generator effectuates power for supplying to the light strip via the power supply line.

6. The decorative light strips for skates as set forth in claim 2 wherein the coupling means comprises a pair of coupling snaps each connected to the control line.

7. The decorative light strips for skates as set forth in claim 2 wherein the light strip further 2 wherein the light strip further surface for reflecting light produced by the lighting means.

8. The decorative light strips for skates as set forth in claim 2 wherein the light strip further includes a phosphorescent surface.

9. The decorative light strips for skates as set forth in claim 2 wherein the lighting means comprises of light emitting diodes.

10. The decorative light strips for skates as set forth in claim 9 wherein the light emitting diodes are connected in parallel.

11. The decorative light strips for skates as set forth in claim 2 wherein the light strip has a specific shape.

12. Decorative light strips for use with skates comprising:

a power means;

a flexible lower layer having an adhesive bottom surface for adhering to a skate;

lighting means securely situated on a top surface of the lower layer and connected to the power means, the lighting means adapted to actuate upon the receipt of power; and a flexible transparent upper layer with a similar size and shape as the lower layer, the upper layer having an adhesive bottom surface for adhering to the lighting means thereby securing each component with respect to each other.

* * * * *